United States Patent [19]

Tone et al.

[11] Patent Number: 4,496,108

[45] Date of Patent: Jan. 29, 1985

[54] BUNCH WINDING DEVICE IN WINDING MACHINE

[75] Inventors: Syoichi Tone, Kyotoshi; Koji Deno, Ohmihachimanshi; Akio Matsushima, Kyotoshi, all of Japan

[73] Assignee: Murata Kikai Kabushiki Kaisha, Japan

[21] Appl. No.: 197,965

[22] Filed: Oct. 17, 1980

[30] Foreign Application Priority Data

Oct. 22, 1979 [JP] Japan ..... 54-136575

[51] Int. Cl.[3] ..... B65H 54/02; B65H 67/04

[52] U.S. Cl. ..... 242/18 PW; 242/35.5 A

[58] Field of Search ..... 242/18 PW, 18 DD, 43 R, 242/35.5 A

[56] References Cited

U.S. PATENT DOCUMENTS

| | | | |
|---|---|---|---|
| 2,036,121 | 3/1936 | Converse et al. | 242/18 PW X |
| 2,096,316 | 10/1937 | Beran | 242/18 PW |
| 3,065,921 | 11/1962 | Furst | 242/18 PW |
| 3,237,876 | 3/1966 | Franzen | 242/18 PW |
| 3,730,447 | 5/1973 | Franzen et al. | 242/18 PW |
| 3,857,523 | 12/1974 | Lenderman | 242/18 PW X |
| 3,942,731 | 3/1976 | Lattion | 242/18 PW |
| 4,057,196 | 11/1977 | Amos | 242/18 PW |
| 4,084,759 | 4/1978 | Piro | 242/18 PW |
| 4,102,507 | 7/1978 | Hoffmann et al. | 242/18 PW |

*Primary Examiner*—Stanley N. Gilreath

*Attorney, Agent, or Firm*—Barnes, Kisselle, Raisch, Choate, Whittemore & Hulbert

[57] ABSTRACT

A L-shaped bunch winding-regulating guide is fixed to a cradle arm so that while a bobbin holder is located at the position for bunch winding on a bobbin, a yarn gripped by the bobbin and bobbin holder is inhibited from shifting to the traverse region on rotation of the bobbin.

4 Claims, 7 Drawing Figures

BUNCH WINDING DEVICE IN WINDING MACHINE

BACKGROUND OF THE INVENTION

Bunch winding is ordinarily carried out when a yarn is wound on a bobbin supported on a bobbin holder in a winding machine.

According to the conventional bunch winding method, a yarn between a drum and the yarn end gripped by the paper tube or between the paper tube and the end face of the bobbin holder is guided outside the traverse region of the paper tube by a yarn handler guide moving in parallel to the bobbin axis, and the paper tube is caused to fall in contact with the surface of a drum and the paper tube is thus rotated to effect bunch winding. In this conventional method, because of the limitation by the amount of the yarn wound on the paper tube, the bunch winding position is restricted to a very narrow region in the end portion of the paper tube. Even if the yarn end is handled to this position by the yarn handler guide, bunch winding is not always conducted at the predetermined position, and it sometimes happens that the yarn intrudes into the wound yarn layer or the yarn falls from the end face of the paper tube and is wound on the bobbin holder, with the result that the bunch winding operation is not carried out stably. Furthermore, provision of such yarn handler guides to respective winding units for performance of bunch winding renders the structure of the winding mechanism more complicated, and if such yarn handler guide is mounted on the side of the doffing device or the paper tube inserting apparatus, the bunch winding position becomes more unstable.

SUMMARY OF THE INVENTION

The present invention relates to a bunch winding device in a winding machine. Bunch winding is carried out when an empty bobbin is attached to a bobbin holder and a yarn is wound on the bobbin.

A primary object of the present invention is to provide an apparatus in which performance of bunch winding on a bobbin at a predetermined position is made possible by simple means.

According to the present invention, a L-shaped bunch winding-regulating guide is fixed to a cradle arm so that while a bobbin holder is located at the position for bunch winding on a bobbin, a yarn gripped by the bobbin and bobbin holder is inhibited from shifting to the traverse region when the bobbin is rotated. Since said guide is formed to have an L-shape so that engagement of the guide with the yarn is released with turning of the cradle arm, when the cradle arm is located at the lifted position, bunch winding can be performed only by rotating the bobbin. While the bobbin is placed on a drum, since the yarn between the bobbin and drum is automatically separated from the L-shaped guide, the ordinary winding operation can immediately be started. In short, according to the present invention, bunch winding can be performed advantageously only by attaching a very simple member to the cradle arm.

The bunch winding device of the present invention can be applied to not only automatic bunch winding but also manual bunch winding.

DETAILED DESCRIPTION OF THE INVENTION

The present invention will now be described in detail with reference to the accompanying drawings.

Figure 1:
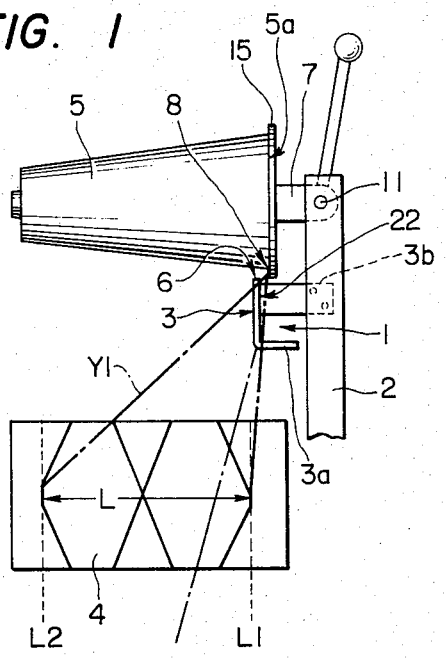
FIG. 1 is a front view showing the structure of the bunch winding device according to the present invention.

Referring to FIG. 1, an L-shaped bunch winding-regulating guide piece 1 comprising a longitudinal plate 3, a lateral plate 3*a* and an attachment face 3*b* is fixed to a cradle arm 2. When the cradle arm 2 is lifted to the paper tube inserting position, the longiduinal plate 3 is located on the side more right than the right limit L1 of the traverse width L of a drum 4 as shown in FIG. 1 and on the left side of the large diameter end face 5*a* of the paper tube as shown in FIG. 1. At this paper tube inserting position, the top end 6 of the front face of the logitudinal plate 3 should be located above the line Y1 connecting the holding point 8 of the yarn gripped by the end face of the paper tube and a bobbin holder 7 to the left end L2 of the traverse region of the drum 4 while the bobbin holder 7 makes at least one rotation. More specifically, referring to FIG. 2, when the yarn is seen from the front, the yarn between the holding point 8 and the drum should be present so that the yarn intersects the front end face 9 of the L-shaped guide piece 1 within the traverse width L of the yarn. Furthermore, the longitudinal plate 3 of the L-shaped guide piece 1 should have a width sufficient to prevent the yarn from coming off from the plate 3 when the yarn is present on the line connecting the paper tube contact point 10 to the contact point 23 of the drum, as shown in FIG. 3. Still further, it is preferred that the top face 24 of the longitudinal plate 3 be arcuate so that a large gap is not formed between the surface of the paper tube 5 and said top face 24. Of course, the arcuate shape is not critical for the top face 24 of the longitudinal plate 3.

The bunch winding method using the bunch winding-regulating guide 1 having the above-mentioned structure will now be described.

Figure 4:
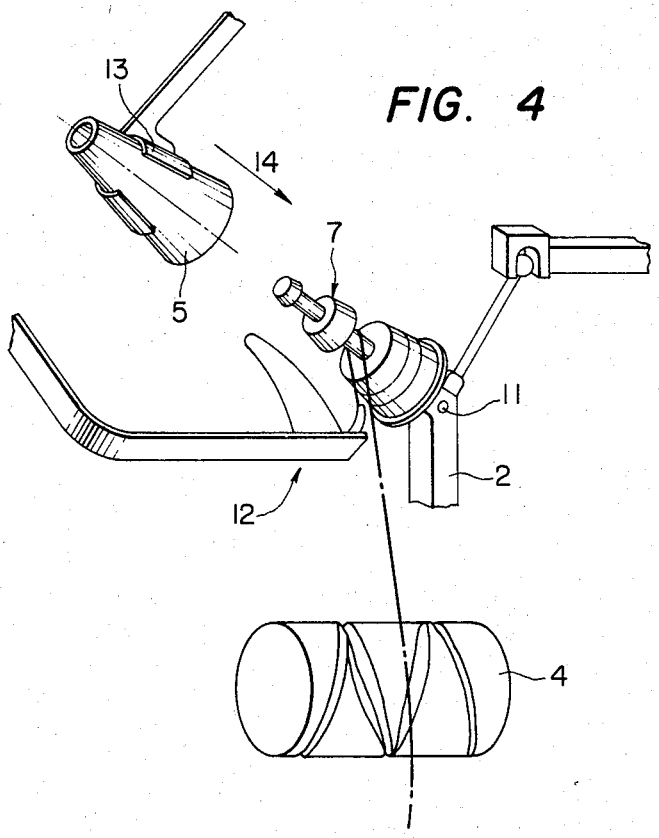
FIG. 4 is a perspective view showing insertion of an empty paper tube into the bobbin holder.

FIG. 4 illustrates the method of attaching an empty paper tube to the bobbin holder, from which a full package has been removed. The bobbin holder 7 which is ordinarily of the cantilever type turns in the direction at a right angle to the axial direction with one axis 11 of the cradle arm 2 being as the center. Accordingly, the bobbin holder 7 can take two positions. When the bobbin holder is located in parallel to the winding drum 4, it holds the paper tube from the interior, and at the other position, it exerts the function of releasing the holding force from the paper tube and keeping the paper tube under such a condition that the paper tube can be exchanged.

Accordingly, when the paper tube is inserted and attached, the bobbin holder turns with the axis 11 being as the center and is located at the releasing position, and the end of the yarn taken out from a yarn supply source is wound on the shaft of the bobbin holder and the yarn end is gripped by a yarn end holding device 12. In this state, an empty tube 5 chucked by a chuck piece 13 is inserted into the bobbin holder 7 from a paper tube store can (not shown) by the sliding movement of the chuck piece 13 in the direction of arrow 14.

Figure 5:
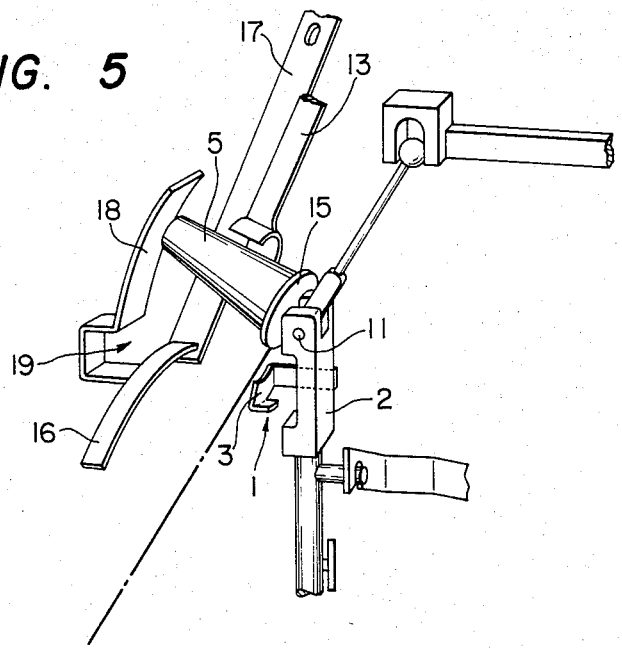
FIG. 5 is a perspective view showing an embodiment of the bunch winding device of the present invention.
Figure 6:
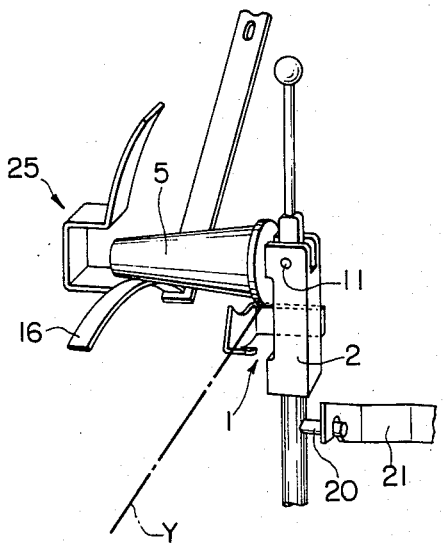
FIG. 6 is a perspective view illustrating the bunch winding operation using the apparatus shown in FIG. 5.
Figure 7:
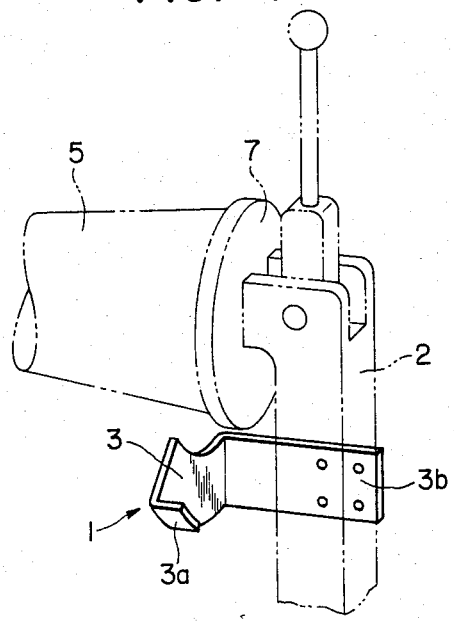
FIG. 7 is a perspective view showing the bunch winding-regulating guide according to the present invention.

Referring to FIG. 5, when the paper tube 5 is inserted to a predetermined position falling in contact with a flange portion 15 of the bobbin holder 7, the chuck piece 13 turns in the direction at a right angle to the shaft of the bobbin holder 7 and separates from the paper tube 5. By the turning movement of an arm 17, curved plate 16 for rotating the paper tube is brought down obliquely from above and a pressing face 18 presses the top end of the paper tube to turn the bobbin holder with the axis 11 being as the center, whereby the large diameter end face of the paper tube 5 is pressed under tension to the flange portion 15 of the bobbin holder and the yarn end is held between the bobbin holder and the large diameter end face of the paper tube. When the bobbin holder is located at this pressing position, the top end portion of the paper tube separates from the pressing face 18 and is kept in the state where the top end portion of the paper tube is placed on the curved plate 16. For this purpose, a concave portion 19 is formed on the curved plate 16. Subsequently, the paper tube having one end placed on the curved plate 16 is rotated by the turning movement of the cradle arm, and bunch winding is performed on the predetermined position of the paper tube. More specifically, referring to FIG. 6, a hooker 21 is engaged with a pin 20. With the hooker 21 retracted, the cradle arm 2 is turned and bunch winding is carried out until the hooker 21 is advanced to again turn the cradle arm 2 and shift the paper tube to the position where the paper tube is placed on a traverse drum.

In the state shown in FIG. 1 where the empty paper tube is inserted and attached and the yarn end is held on the bobbin holder, if the paper tube 5 is rotated to the front side in the drawings, though the yarn is going to move toward the traverse region, the yarn is inhibited from moving to the left by engagement with the side face 22 of the longitudinal plate 3 of the guide piece 1, and the yarn is wound on the bunch winding position of the paper tube 5 in the right end portion thereof. More specifically, as shown in FIG. 3, when the paper tube 5 is rotated in the direction of arrow A, since the first contact point between the yarn and the paper tube 5 is always in the vicinity of the point 10, the line connecting said contact point 10 to the contact point 23 on the drum 4, that is, the yarn Y2, is always in the region of the longitudinal plate 3. Accordingly, movement of the yarn to the left in FIG. 1 is inhibited, and the yarn is wound on the end portion of the paper tube, that is, between the longitudinal plate 3 and the end face 5*a* of the paper tube 5.

Figure 2:
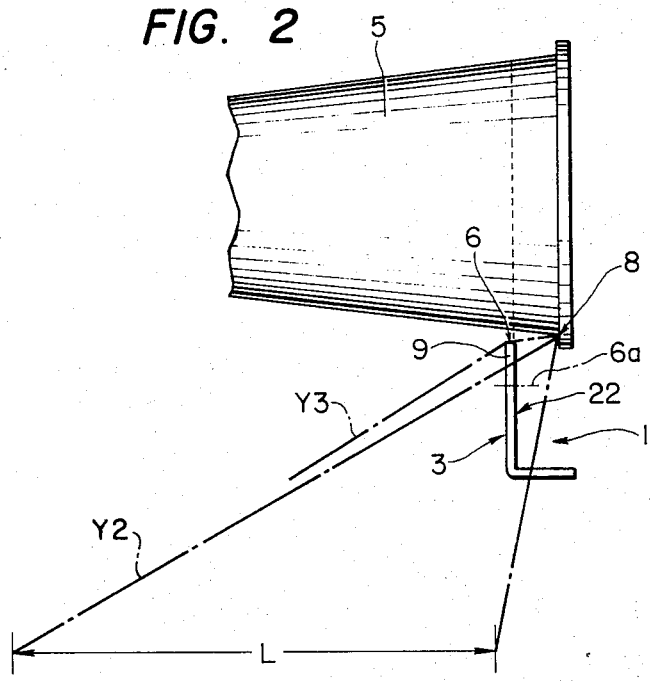
FIG. 2 is a diagram illustrating main parts of the device shown in FIG. 1.
Figure 3:
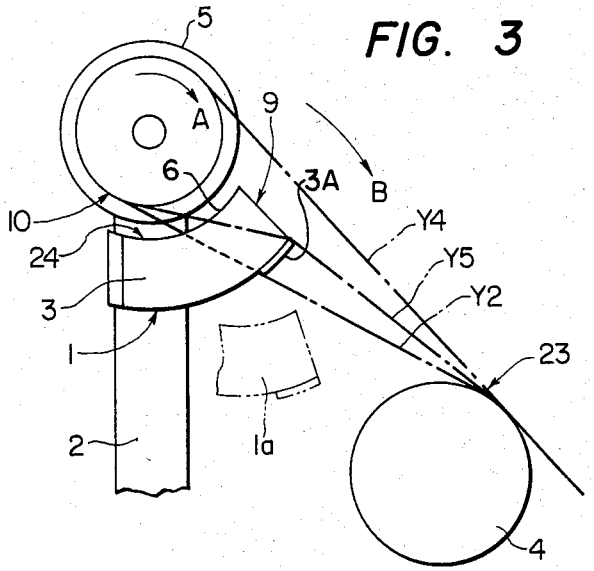
FIG. 3 is a side view illustrating the functions of the guide piece.

In FIG. 2, when the paper tube is inserted and attached, if the yarn Y3 is held in the state where slackness is produced from the left end portion of the drum, it sometimes happens that the yarn is held in the state where the yarn goes beyond the top face 6 of the longitudinal plate 3. In this case, if the paper tube 5 is rotated in the bunch winding direction, that is, in the direction of arrow A in FIG. 3, the yarn is not inhibited by the longitudinal plate 3 and is caused to come off from the guide piece, rendering performance of the bunch winding operation impossible. In this case, by making substantially one rotation of the paper tube 5 in the direction opposite to the direction of arrow A in advance, the yarn caught on the top face 6 of the longitudinal plate 3 is separated from said top face and the yarn is in the state Y4 shown in FIG. 3 and located in front of the guide piece 1. When the paper tube 5 is rotated in this state in the direction of arrow A, the yarn Y4 becomes engaged with the front end face 9 of the longitudinal plate 3 and the yarn is in the state Y5 shown in FIG. 3. In this state, the yarn is prevented from coming off from the regulating guide piece 1 and is wound in several turns between the longitudinal plate 3 of the guide piece 1 and the end face of the paper tube.

While the bunch winding operation is thus carried out, the cradle arm 2 is turned in the direction of arrow B in FIG. 3 and the paper tube 5 is placed on the drum 4, whereby the yarn is caused to separate from the longitudinal plate 3 and an ordinary traverse operation is conducted with rotation of the drum. Namely, in FIGS. 2 and 3, when the cradle arm 2 is turned in the direction of arrow B, the bunch winding regulating guide piece 1 fixed to the cradle arm 2 is simultaneously turned down to the front. That is, in FIG. 2, the top end 6 of the longitudinal plate 3 is substantially brought down, and this top end 6 arrives at the position 6*a* indicated by a one-dot chain line. At this point, the yarn is not engaged with the front end face 9 of the longitudinal plate any more and the yarn between the drum 4 and the paper tube 5 is brought into the state Y2 shown in FIG. 2 and is caused to come off from the guide piece 1*a*.

In the foregoing illustration, a cantilever type bobbin holder is described. In the present invention, however, a center bobbin holder can also be used and other bobbins such as wooden bobbin may be applied.

What is claimed is:

1. A bunch winding device for a winding machine including a cradle arm, a drum having a traverse region, a bobbin holder secured to the cradle arm for rotatably mounting a bobbin adjacent the drum, and means for mounting said cradle arm for movement between a first position wherein the bobbin engages said drum and a lifted position wherein said bobbin holder and bobbin are spaced from said drum, comprising an L-shaped bunch winding-regulating guide having a longitudinal plate with a top end and top face being attached to the cradle arm below the bobbin holder so that the bunch winding-regulating guide is in engagement with a yarn extending from the drum toward the yarn end gripped by an end face of the bobbin and bobbin holder when the cradle arm is located in said lifted position, and it releases said engagement with the yarn on movement of the cradle arm from said lifted position to said first position, wherein the longitudinal plate of said L-shaped bunch winding-regulating guide is located outside the traverse region of the drum and is also positioned between the traverse region of the drum and the end face of the bobbin.

2. A bunch winding device as claimed in claim 1, wherein a top end of said longitudinal plate is located above the line connecting the holding point of the yarn gripped by the end face of the bobbin and the bobbin holder to the end of the traverse region of the drum furthest from the holding point where the yarn contacts the drum while the bobbin holder makes at least one rotation.

3. A bunch winding device as claimed in claim 2, wherein said longitudinal plate of the L-shaped guide has a width sufficient to prevent the yarn from coming off from the longitudinal plate when the yarn is present on a line connecting the holding point of the yarn gripped by the end face of the bobbin and the bobbin holder to the furthest end of the traverse region of the drum furthest from the holding point where the yarn contacts the drum.

4. A bunch winding device as claimed in claim 3, wherein the top face of the longitudinal plate is arcuate so that a large gap is not formed between the surface of the bobbin and the top face.

* * * * *